US007748064B2

(12) United States Patent
Hamilton

(10) Patent No.: US 7,748,064 B2
(45) Date of Patent: Jul. 6, 2010

(54) PERSONAL SEATED RESTING SUPPORT

(76) Inventor: Gordon Blackwood Hamilton, The Old Masters House, Brandeston Hall, Brandeston, Woodbridge IP13 7AH (GB)

( * ) Notice: Subject to any disclaimer, the term of this patent is extended or adjusted under 35 U.S.C. 154(b) by 0 days.

(21) Appl. No.: 12/158,029

(22) PCT Filed: Dec. 19, 2006

(86) PCT No.: PCT/GB2006/004779

§ 371 (c)(1),
(2), (4) Date: Aug. 14, 2008

(87) PCT Pub. No.: WO2007/071977

PCT Pub. Date: Jun. 28, 2007

(65) Prior Publication Data

US 2008/0303318 A1 Dec. 11, 2008

(30) Foreign Application Priority Data

Dec. 21, 2005 (GB) ..... 0526079.9
Jan. 24, 2006 (GB) ..... 0601457.5
Aug. 11, 2006 (GB) ..... 0615985.9

(51) Int. Cl.
*A47C 20/02* (2006.01)

(52) U.S. Cl. ..... 5/632; 5/652; 5/657; 248/118; 297/394; 297/488

(58) Field of Classification Search ..... 297/170, 297/174 R, 188.2, 394, 487, 488; 5/632, 5/643, 652, 657; 248/118
See application file for complete search history.

(56) References Cited

U.S. PATENT DOCUMENTS 245,639 A * 8/1881 Lay ..... 297/394

(Continued)

FOREIGN PATENT DOCUMENTS

GB 0278104 10/1927

(Continued)

*Primary Examiner*—Peter R. Brown
(74) *Attorney, Agent, or Firm*—Kirton & McConkie; Michael F. Krieger

(57) ABSTRACT

The present invention relates to a resting support (10) for supporting portions of a resting person (1) in a forwards leaning seated position, and to a method of using such a support. The resting support (10) comprises at least one supporting section (9, 35) including a main supporting section (9) for supporting directly said seated resting person's upper torso (3) and head (9), and means for positioning and supporting said section(s) (9, 35) above the lap (6) of said person (1) including at least two legs (21, 22) that extend downwardly from one or more of said sections (9, 35), wherein: —the main supporting section (9) in use extends at an upwards sloping angle (27) from a lower region (28) for supporting said person's upper torso (3) towards an upper region for supporting said person's head (2); —said at least two legs include at least one rear leg (22) proximate said lower region (28) and at least one forwards leg (21) proximate said upper region, the rear leg(s) (22) being adapted for engaging with a seat (25) on which said person (1) is seated and the front leg(s) (21) being adapted for engaging with a floor (24) beneath said seat (25), said at least two legs (21, 22) being movable relative to said sections (9, 35) to enable the section(s) to fold flat with said legs when not in use.

22 Claims, 3 Drawing Sheets

U.S. PATENT DOCUMENTS

| | | | | | |
|---|---|---|---|---|---|
| 1,260,929 | A | * | 3/1918 | Maxcy | 297/394 |
| 1,403,317 | A | | 1/1922 | Gross | |
| 2,451,653 | A | * | 10/1948 | Bazelon | 248/205.6 |
| 2,460,712 | A | * | 2/1949 | Peterson | 297/174 R |
| 2,601,177 | A | | 6/1952 | Smullen | |
| 3,050,355 | A | | 8/1962 | Hess et al. | |
| 3,090,051 | A | * | 5/1963 | Oakland | 4/254 |
| 3,138,403 | A | * | 6/1964 | Danielson | 297/174 R |
| 3,247,811 | A | | 4/1966 | Bauder | |
| 3,828,377 | A | | 8/1974 | Fary, Sr. | |
| 4,494,465 | A | * | 1/1985 | Fick, Jr. | 108/44 |
| 5,645,319 | A | | 7/1997 | Parks, Jr. | |
| 5,711,572 | A | * | 1/1998 | Khan | 297/140 |
| 5,779,112 | A | * | 7/1998 | Krulik | 297/129 |
| 5,865,181 | A | * | 2/1999 | Spence, Jr. | 5/637 |
| 5,920,917 | A | * | 7/1999 | Landsberger | 4/235 |
| 5,971,485 | A | | 10/1999 | Clark | |
| 6,007,156 | A | | 12/1999 | Chang | |
| 2003/0172462 | A1 | | 9/2003 | Hoggatt et al. | |
| 2004/0064893 | A1 | | 4/2004 | Sharp | |
| 2004/0262865 | A1 | | 12/2004 | Sigler | |

FOREIGN PATENT DOCUMENTS

| | | |
|---|---|---|
| GB | 0724315 | 2/1955 |
| GB | 1501397 | 2/1978 |
| NL | 1017050 | 9/2002 |
| WO | WO8201983 | 6/1982 |
| WO | WO2004084671 | 10/2004 |

* cited by examiner

PERSONAL SEATED RESTING SUPPORT

BACKGROUND a. Field of the Invention

The present invention relates to a resting support for supporting portions of a resting person in a forwards leaning seated position, and to a method of using such a support.

b. Related Art

A travelling passenger, for example on an aircraft, may need to sleep during a long journey. In economy class seating accommodation, a person may be forced to sleep sitting almost upright in a seat. The key distinction of such non-horizontal sleeping is that some body elements are required to support each other, wholly or partially. A number of problems result from this. Additional weight stresses are transmitted through joints and musculature, for example, muscles and the spine transmit most of the weight of the head and arms to the upper torso and thence from the upper torso to the lower torso and thighs. Additional contact pressure is created between some body elements and their supporting surfaces due to transmitted weight from adjacent body elements. For example, the lower torso (hips and buttocks) and thighs carry the extra weight of the upper torso, head and arms which is translated into increased contact pressure between them and the supporting seat base.

Prior art solutions to the problem of resting during a journey mostly involve various contortions adopted by the seated traveller to alleviate the stresses and strains, for example: leaning the head, upper torso, and arms against the seat back and head rests in various ways; leaning the head, upper torso, and arms against the seat arms; leaning the head, upper torso and arms on one's own thighs and knees; or leaning the head and/or shoulders and/or arms on the seat in front or some other support standing on the floor spaced in front of a seated individual. All of these methods involve weight transfer between body elements, caused by counterbalancing the elements of support, for example: upper torso to head; upper torso to arms; upper torso to lower torso, lower torso to seat, etc. This creates associated joint and musculature stresses. Consequently these methods do not provide the benefit of an ideal horizontal sleeping position in which each body portion or element bears only its own weight so that stresses transmitted through joints and musculature are avoided and contact pressure between each body element and its supporting surface (the bed) is minimised.

In particular, none of these methods prevent the upper torso weight, the heaviest individual element of the human body, from bearing down on other body elements: head, arms, lower torso, and thighs and thereby increasing pressure on these body elements and transmitting support stresses through joints and musculature.

SUMMARY OF THE INVENTION

According to the invention, there is provided a resting support for supporting portions of a resting person in a forwards leaning seated position, comprising at least one supporting section including a main supporting section for supporting directly said seated resting person's upper torso and head, and means for positioning and supporting said section (s) above the lap of said person including at least two legs that extend downwardly from one of more of said sections, wherein:

the main supporting section in use extends at an upwards sloping angle from a lower region for supporting said person's upper torso towards an upper region for supporting said person's head;

said at least two legs include at least one rear leg proximate said lower region and at least one forwards leg proximate said upper region, the rear leg(s) being adapted for engaging with a seat on which said person is seated and the front leg(s) being adapted for engaging with a floor beneath said seat, said at least two legs being movable relative to said sections to enable the section(s) to fold flat with said legs when not in use.

Also according to the invention, there is provided a method of using such a resting support to rest a person's body, the method comprising the steps of:

i) unfolding said section(s);

ii) engaging said rear leg(s) on a seat on which said person is seated;

iii) engaging said front leg(s) with a floor beneath said seat, iv) using the means for positioning and supporting said section(s) so that the main supporting section is positioned above the lap of said seated person; and v) resting the upper torso and head on the main supporting section.

The legs for positioning and supporting the sections may be provided as separate independent supports at points which substantially span the extent of the main supporting section. Step v) above may therefore include positioning the weight of the person resting on the sections substantially between the span of the separate independent supports.

There may be one forwards leg proximate the upper region and a pair of rear legs proximate the lower region. The rear legs may then be spaced apart to be positioned in use either side of the person's legs or hips.

A generally upwards sloping angle of the resting support together with the rear leg(s) that engage with a seat on which said person is seated are important features of the invention, as these features ensure the stable positioning of the resting support during use, as well as providing a natural and comfortable resting position. The or each of the rear legs position a lower region of the supporting section between a lower portion of the upper torso and the person's lap, while all or substantially all of the weight on the lower portion of the main supporting section is transmitted downwards onto the seating surface on which the person is seated rather than onto the resting person's lap. The positioning of the lower region of the main supporting surface in the constrained space between the lower portion of the upper torso and the person's lap steadies the resting support from tilting forwards under the force imparted by the weight of the resting person on the resting support, which will generally be directed downwards and forwards. There is therefore no need for the resting support to have a heavy or bulky base or for any type of cantilevered supporting arrangement or rigid fixing with the seat or floor in order to prevent forwards tipping of the resting support and to position and hold the resting support in a stable position during use.

A significant benefit of the invention is that by directly supporting the upper torso, problems associated with body elements such as the head, arms, lower torso, and thighs bearing weight from other body elements is eliminated or greatly reduced.

The invention lends itself to forming an easily portable and relatively lightweight yet stable resting support which can readily be carried by hand on a journey, and then unfolded and situated for use as needed.

Because of the compact fold-flat arrangement, the invention allows a passenger travelling, say, on an overnight journey, to take with them the resting support and sleep comfortably in a forwards leaning seated position by stably and directly supporting the weight of the upper torso, which is the largest and heaviest element of the body's parts. This state is achieved for the traveller by resting his/her upper torso forward onto an inclined, stably supported (i.e. primarily non-cantilevered) main support section stretching from the waist to the head and, approximately, of torso width.

The resting support may include a pair of side supporting sections for supporting directly the person's arms, in which case the support may be of approximately shoulder width. The side supporting sections in use are then positioned so as to support said person's arms at a lower level than said person's head. The side supporting sections are preferably movable relative to the main supporting section and said at least two legs to enable the section(s) to fold flat with the legs when not in use.

The main supporting section has left and right sides relative to the person, the side supporting sections being positioned at the left and right sides of the main supporting section.

The main supporting section is preferably movable relative to both side supporting sections so that when not in use the pair of side supporting sections conforms with the shape of the left and right sides of the main supporting section.

In a preferred embodiment of the invention, the side supporting sections are movably connected to the lower region of the main supporting section. For example, the side supporting sections may be movably connected to the lower region by means of at least one hinge, or alternatively, by means of a flexible linkage.

Also in a preferred embodiment of the invention, a member extends from at least one of the legs for locating the position of the side supporting sections when used to support the person's arms at the lower level. The member is then movable relative to the at least one leg to enable the section(s) to fold flat with the associated leg(s) when not in use.

In a preferred embodiment of the invention, the member is elongate and is rotatably connected to the forwards leg about a mid-point of the elongate member. This arrangement is convenient in that this helps the resting support to fold flat when not use.

It is particularly advantageous if the connection point of the legs to the main supporting section substantially span the extent of the main supporting section so that the weight of the person resting on the sections lies substantially between the span of the separate independent supports.

In this embodiment, the main supporting section is provided by a continuous surface, which is also planar. Alternatively, this continuous surface could be concave towards the upper torso of the seated person. Such a concave arrangement can increase conform and may also help to stabilise the torso laterally, thereby improving the lateral stability of the resting support while in use.

The invention additionally provides an item of luggage, comprising: an external casing; means for opening and closing the external casing, the casing extending across a plurality of sides, at least one of the sides including a substantially rigid external panel; and means by which the panel may be removed and attached to the side of the casing; wherein the panel is formed from a collapsed resting support, the resting support being according to the invention when not in use and when folded flat.

The legs may be folded flat with the sections after the person has finished resting using the resting support.

BRIEF DESCRIPTION OF THE DRAWINGS

The invention will now be further described, by way of example only, and with reference to the accompanying drawings, in which.

DETAILED DESCRIPTION

Figure 1:
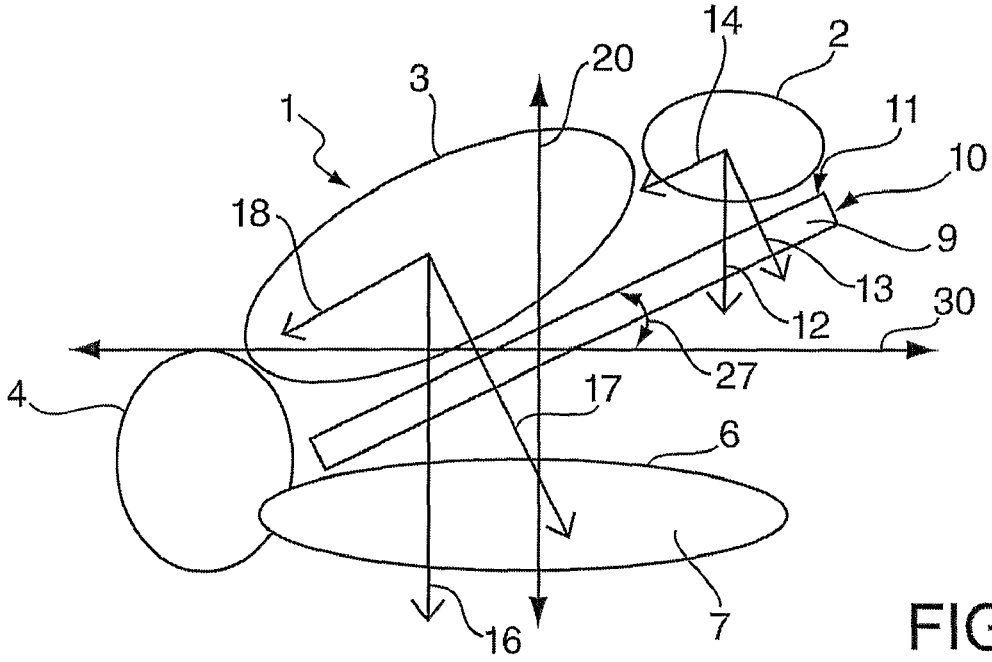
FIGS. 1 and 2 are, respectively, side and top views of a schematic representation of a body resting on a forwards inclined resting surface.
Figure 2:
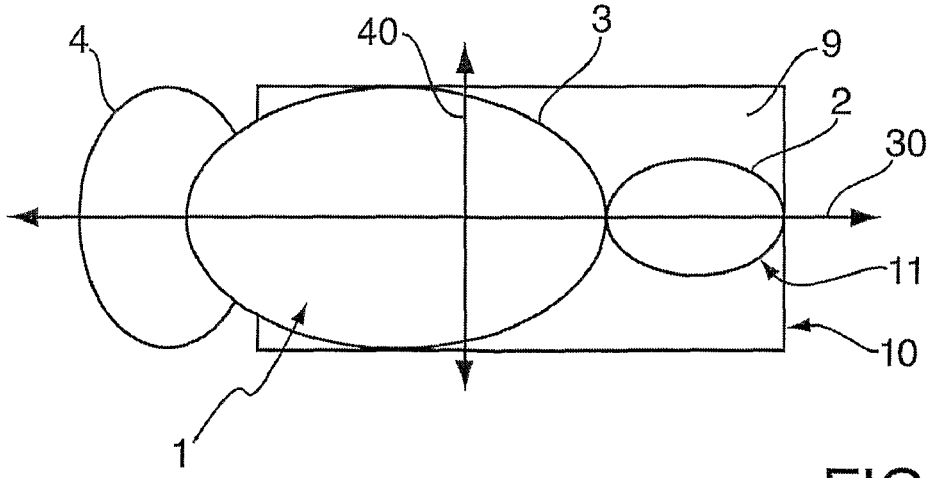

FIGS. 1 and 2 illustrate schematically various considerations when a person 1 is resting on a forwards leaning resting support 10. The resting support 10 is shown in detail in FIGS. 3 and 4, and has a main supporting section 9 with a supporting surface 11 which may be planar or gently curved or contoured. The person's head 2 and upper torso 3 each exert a downwards force 12, 16 from gravity parallel with a vertical axis 20. These downwards forces 12, 16 can each be resolved relative into two components relative to the plane or general extent of the supporting surface 11. One component 13, 17 is perpendicular to the supporting surface 11 and is therefore borne entirely by the resting support 10. The other component 14, 18 is parallel with the supporting surface 11 and may be carried down the upper torso towards the person's hips 4. In fact, most of the parallel components 14, 18 can be coupled by friction between the supporting surface and head 2 and upper torso 3 into the resting support 10, thereby negating almost all transmitted forces between upper body portions. Although not shown in FIG. 1, similar force components exist for the arms 5 if these are rested on the supporting surface 11. A forwards leaning main supporting section 9 will therefore substantially eliminate any transmitted joint and musculature stress between different parts of the body.

The resting support 10 may also need to bear some lateral forces along a horizontal axis 40, but these will be far smaller than those originating from the downwards weight 13, 17, owing to the natural balancing effect between left side forces and right side forces.

Figure 3:
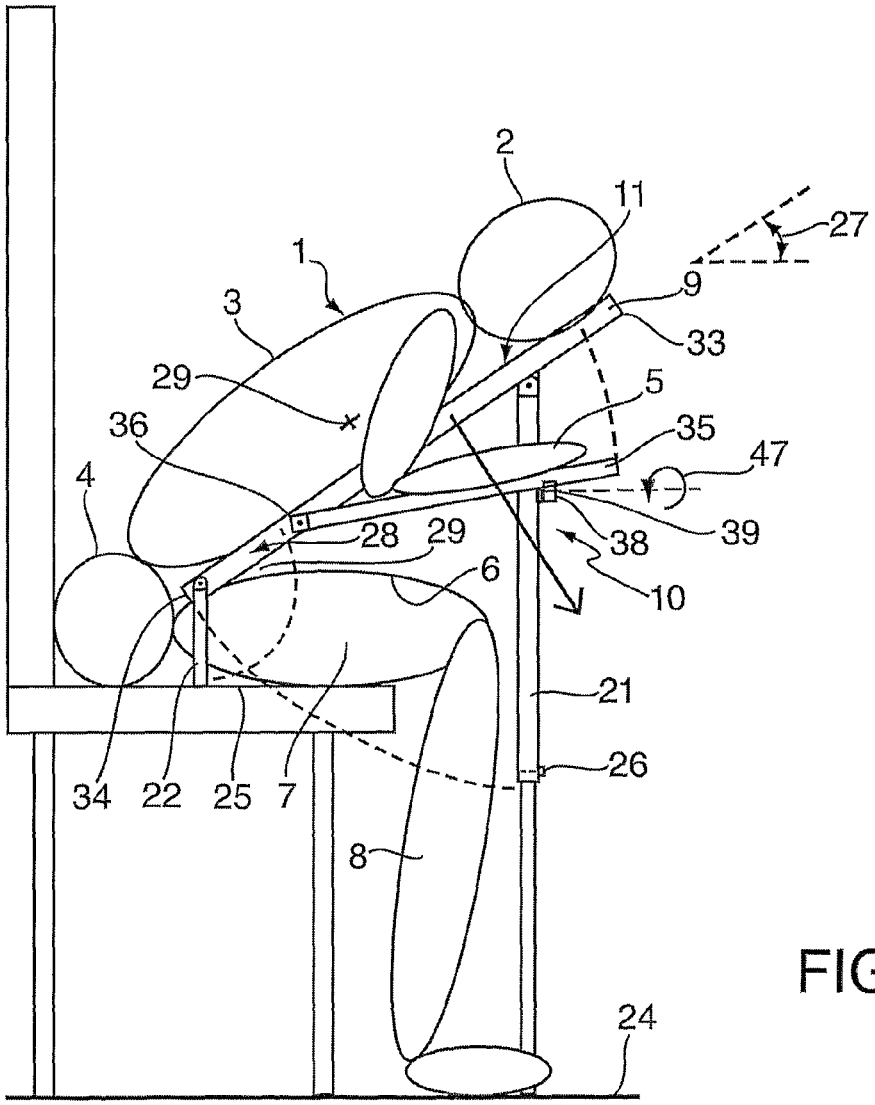
FIGS. 3 and 4 are, respectively, schematic side and top views, similar to those of FIGS. 1 and 2, showing a seated person resting on a resting support according to a first preferred embodiment of the invention.
Figure 4:
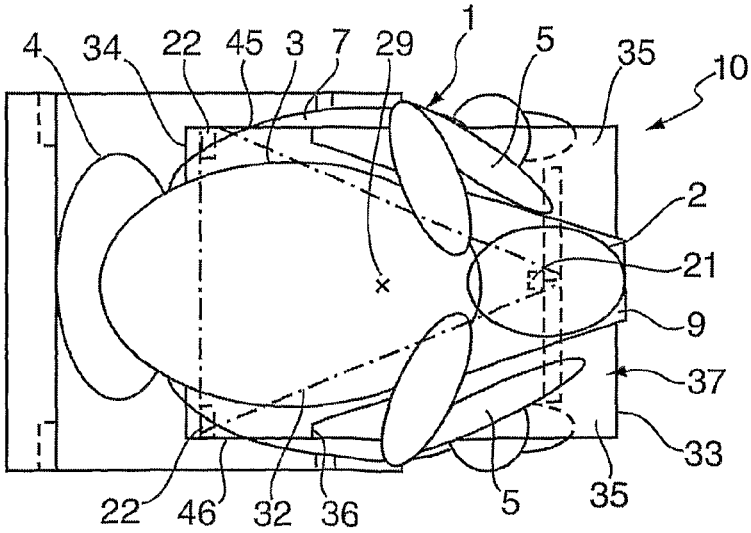

The resting support 10 provided by the invention, shown in more detail in FIGS. 3 and 4, can bear these forces, and resist any tendency of the main supporting section 9 to tip forwards owing to the downwards and forwards directed resolved force components 13, 17. As will be described, below, the invention provides stability for the main supporting section 9 this without the need for any cantilevered supporting arrangement or any heavy counterbalanced base.

As shown in FIGS. 3 and 4, this is achieved by having at least two separate supporting legs, in this example one 21 to the fore and a pair 22 to the aft of the supporting surface 11, principally supporting the resolved force components 13, 17. The fore leg 21 is longer than the pair of rear legs 22 and are therefore adapted to engage with the floor 24, while the rear legs 22 are adapted to engage with a seat surface 25 on which the user 1 is seated. The fore leg 21 has a telescopic adjustment 26 so that the incline or angle 27 of the main supporting section relative to horizontal 30 can be adjusted, and so that the rear legs 22 can engage properly with the seat surface 25. Optionally, the rear legs 22 may have a length adjustment or be telescopically adjustable.

Support for any side-to-side components of force may also be required, but as this will usually be a much smaller force, may not require any additional supporting or bracing arrangement, such as an inverted "T" base extending left to right from the legs 21, 22.

The resting support 10 is therefore free-standing with no direct connection to any supporting surface or to the seat 25.

The angle 27 should be less than about 50° to minimise resolved force components 14, 18 in the plane of the main supporting section 9, but greater than about 10° so to avoid stresses on the lower back from being bent double. Most preferably, the angle should be between 40° and 15°. This range of angles also helps position a lower region or portion 28 of the main supporting section 9 in a small gap 29 between the seated person's lap 6 or thighs 7 and the upper torso 3. This orientation is important because any tendency for the resting support 10 to tip forwards owing to the forwards components of the resolved forces 13, 17 will be resisted by the contact or near contact between the main supporting section 9 and the person's upper torso 3 or lap 6 in the vicinity of this gap 29.

As can be seen, the resting support 10 directly supports the weight of the upper torso 3, head 2 and arms 5 of a seated user 1. As explained above, the resting support 10 is stably supported which is to say it will stand on its own supports and does not require the users body to counterbalance it. The main supporting section 9 is not cantilevered along either of the horizontal axes 30, 40

The use of a pair of aft legs 22 to the left and right of the hips 4 and one fore leg 21 extending downwards from the region of the head 2 ensures that a centre of gravity 29 of the upper torso, head and arms, projected downwards, is within the horizontal area 32 defined by the contact of the supports with the seat 25 and floor 24. It is for this reason that the legs 21, 22 provide separate and independent support at or near opposite edges 33, 34 of the main supporting section.

The legs 21, 22 therefore position the main supporting section 9 under the upper torso 3 and head 2 of a user 1 while he is sitting normally and getting maximum support for his lower torso (hips and buttocks) and legs from the seat 25. Crucial to this positioning are the function of the aft support (s) 22 which should be low enough to get the main supporting section 9 under the waist and close to the hips 4. In this position the centre of gravity 29 of the upper torso 3, head 2 and arms 5, projected down through the supporting sections 9, 35 is within the span of the legs 21, 22, providing for good stability and support.

The invention is particularly useful when used as a portable resting support for use by a traveler during his or her travels. The resting support 10 is therefore designed to be both lightweight and portable. This is achieved by using the two or more separate supports 21, 22, resulting in minimal or zero cantilevering support for the main forces acting on the main supporting section 9.

Further, the main supporting section 9 is designed to carry only the weight of the upper torso 3 and head 2, not the whole body. The arms 5 may be rested on the person's lap 6, but are most preferably supported on a pair of side supporting sections 35, which are connected by hinges 36 to the lower portion 28 of the main supporting section 9. Each side supporting section is supported at a forwards portion 37 by a pivotable cross member 38 connected at a pivot joint 39 to the centrally positioned forwards leg 21. The member 38 swivels from the vertical axis 20 to the lateral horizontal axis 40 to forming a cross with the fore leg 21 and thereby locates the drop down side support sections 35 when in use.

The lower body weight of the lower torso 4 (hips and buttocks) thighs 7 and lower legs 8 is supported by the seat 25 and floor 24. Thus the main and side support sections 9, 35 have to carry approximately between about 30 kg and 60 kg rather than the full body weight of approximately between 50 kg and 100 kg that, say, the supports of a bed, chair or bench would be designed to carry.

Both these considerations permit the lightweight construction for the resting support 10, thereby, providing for the essential and unique convenience and practicality of the device.

Figure 5:
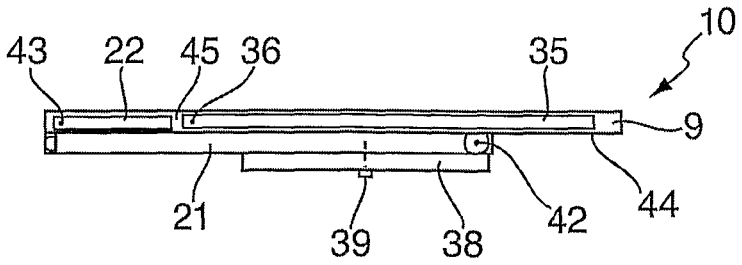
FIG. 5 is a left hand side view of the resting support when collapsed to fold flat.
Figure 6:
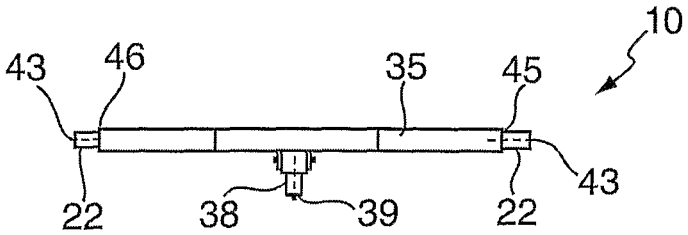
FIG. 6 is a front view of the resting support when folded to collapse flat.
Figure 7:
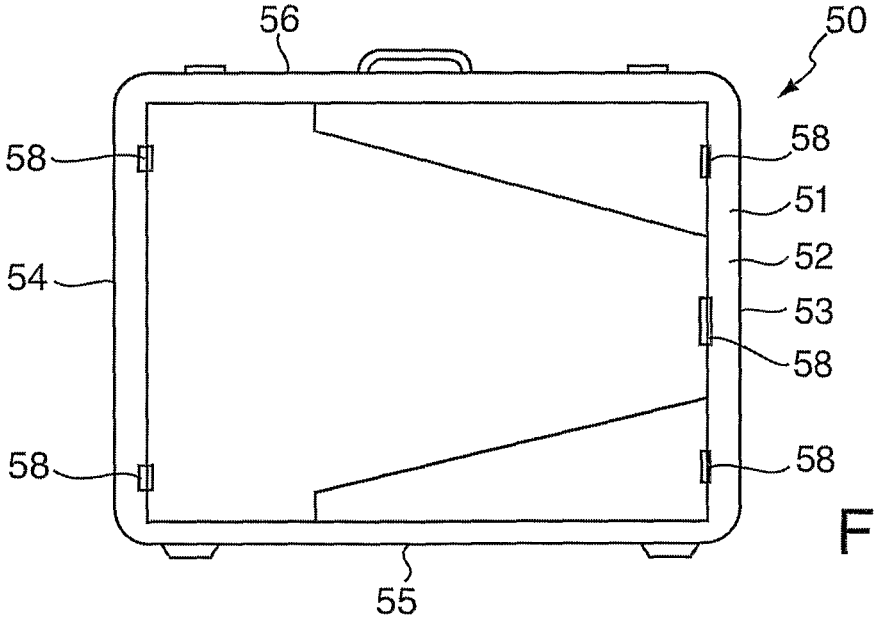
FIG. 7 is a side view of an item of luggage incorporating collapsed resting support according to a second preferred embodiment of the invention.
Figure 8:
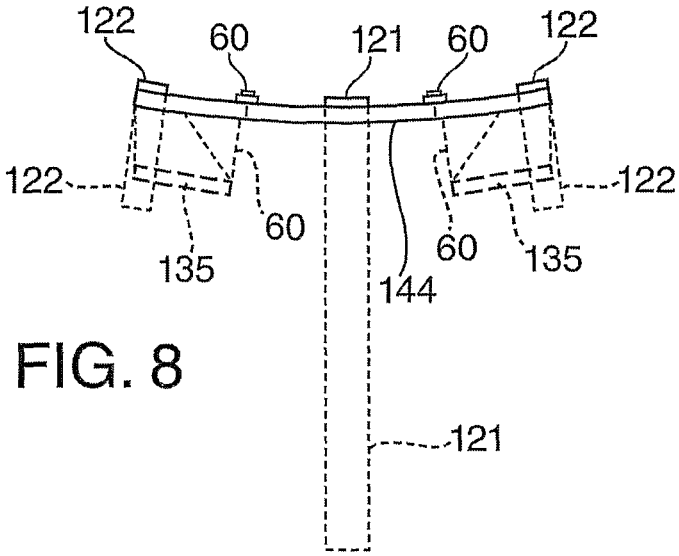
FIG. 8 is a front view of resting support of FIG. 7 when separated from the remainder of the item of luggage.

Because the resting support 10 may be used when travelling, the resting support is collapsible in that this may be folded flat, which term includes being collapsed flat, when not in use, as illustrated in FIGS. 5 and 6. The legs 21, 22 are capable of being folded and stowed in or against the supporting sections 9, 35. Alternatively, these may be collapsed in another way, such as being detachable and connectable against or stowed within the body supporting sections 9, 35. Any of the legs 21, 22 may be adjustable for length to set the height and angle of the main supporting section 10.

The material of the supporting sections 9, 35 may be manmade or natural, rigid, pliant or deformable. For example, these sections could be constructed using lightweight metal, or injection moulded plastic, or canvas within a metal or plastic frame, or using an inflatable membrane, or a combination of these. The supporting sections 9, 35 may be adorned with padding or cushions to facilitate comfort or, in a simpler form, left bare to allow the users to provide their own form of cushions. The pliancy or deformable nature of the device materials, or the padding or cushions, may contribute to the final (in use) profile of the supporting sections 9, 35, for example convex, concave, or contoured.

The design of the supporting sections 9, 35, may take various forms, for example either flat and one piece in its simplest form, or convex or concave, either uniformly or variably contoured. Pliant or deformable materials, suggested above, or the padding or cushions could create or enhance ergonomic contours in use.

The supporting sections 9, 35 may be one piece or sectional, similar to the convex or concave contoured designs but comprising more than one section so that the tilting or suspended sections of the device allow for the sympathetic, ergonomic positioning of the upper torso, head and arms in relation to one another.

To facilitate portability of the resting support 10, the design may be capable of being broken down into smaller connected or separate sections when to be folded flat. For example, one or more of the supporting sections may be designed to fold in half when not in use.

FIGS. 5 and 6 show how the resting support 10 may be collapsed flat when not in use. Both the fore and aft legs 21, 22 are connected to the main support section at pivots 42, 43. The fore leg pivots upwards to lie flat against an under surface 44 of the main supporting section 9, while the rear legs pivot upwards against left and right sides 45, 46 of the lower portion 28 of the main supporting section 9. The cross member 38 rotates 47 parallel with the fore leg 21. The side sections 35 each rotate upwards to lie in the same plane as the main supporting section 9. A second embodiment of a resting support 110 is illustrated as part of an item of luggage according to another aspect of the invention. Features of the second embodiment of the resting support 110 which correspond with those of FIGS. 1 to 6 are indicated by reference numeral incremented by 100.

The item of luggage is here a suitcase 50, having an external casing 51 with six opposite sides, five of which 52-56 are indicated in the drawing. One side 52 has a recess which incorporates the second embodiment of the resting support 110 so that when the resting support is inserted in the recess, a smooth convex external surface 144 of the resting support formed an outer surface of the suitcase 50.

The resting support is removable located and held to the recess by means of a release mechanism, which is here five key operated latches 58 spaced around the periphery of the recess in the suitcase side 52.

In this embodiment, the legs 121, 122 fold up against a concave resting surface 111 of the main supporting section 109, and drop down as shown in dotted outline to provide fore and aft support as described above. The side arm supports 135 also drop down into a position lower than the main supporting section 109, and are each held in place by means of a cord 60 that extends between side supporting section and the main supporting section 109.

In this embodiment, the main supporting section 109 and side supporting sections 135 are both concave and provide support to the upper torso 3, head 2 and arm 5 on uniformly curved surfaces.

After use, the resting support may be folded flat, and then re-attached to the recess in the side of the suitcase.

In this manifestation of the invention the support sections 109, 135 takes the form of an inverted, shallow tray approximately 400 to 450 mm wide, 500 to 600 mm long and 20 to 30 mm deep. The top of the inverted 'tray' provides the convex or concave support surface 111.

In its folded form the tray-like resting support 110 could alternatively be to the side of a large briefcase for ease of carriage, or be an integral part of another piece of luggage, forming for example the rigid base of an otherwise flexible material bag, or the back of a back-pack. When in use the legs are folded out and support the entire supporting section(s), with two rear legs rest on a seat on each side of the user's pelvis 4 and with the front leg resting on the floor 24.

The resting support may take different forms. For example, the or each supporting section could be formed from a moulded, one piece surface. In a relatively simple moulded form this takes the form of an inverted, triangular, shallow basin with blunt corners. The base of the triangle would span the hips 4 to allow the short rear, adjustable legs to deploy. Alternatively, there in this embodiment or any of the previously described embodiments, there could be a single central rear, adjustable leg with a lateral inverted 'T' foot to provide the secondary, and minimal, lateral stability. The point of the triangle would be towards the head 2 and incorporate the forward extendable leg. The upper torso 3 would be supported by the central body of the inverted basin, which could be moulded to make a better fit against the chest area, and an ancillary arm side supports would be along opposite inverted lips of the basin, each lip being enlarged to conform with the diameter of an arm.

The resting supports 10, 110 described above, by directly supporting the upper torso 3, allows the head 2, arms 5, lower torso 4 and thighs 7 to support only their own weight, which approximate the key distinction of the ideal sleeping position in which each body element supports only its own weight.

Optionally, the resting support may include means for adjusting the length of the support to suit individuals of differing upper body length.

A defining feature of the resting support 10, 110 is therefore that for someone in a seated position, the direct support of the upper torso 3 in a resting position by the main supporting section 9, 109 largely eliminates weight transfer stresses between body elements thereby allowing each body element to support only its own weight.

The resting support 10, 110 described above provides the traveller with a stably supported supporting section(s) that substantially supports the weight of his/her upper torso (waist to head) and thereby eliminates or significantly reduces weight transfer from the upper torso to other body elements such as head, arms, lower torso and thighs.

The resting support device is lightweight, portable, and may be adjusted for his/her upper torso and preferred resting angle as well as for use with any kind of seat.

The lightweight, compact nature of the resting support device also allows the device to be incorporated into other useful artifacts of the traveller, for example the side of a suitcase could be detached to form the resting support, or the moulded spine of a back-pack could be utilised as the resting support.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately, or in any suitable combination.

It is to be recognized that various alterations, modifications, and/or additions may be introduced into the constructions and arrangements of parts described above without departing from the spirit or scope of the present invention, as defined by the appended claims.

The invention claimed is:

1. A resting support for supporting portions of a resting person in a forwards leaning seated position, comprising at least one supporting section including a main supporting section, the main supporting section having a supporting surface for supporting directly said seated resting person's upper torso and head, the main supporting section being elongate between opposite first and second ends of the main supporting section such that the supporting surface may provide support along its length to said seated resting person's upper torso and head, and means for positioning and supporting said section(s) above the lap of said person including at least two legs that extend downwardly from one or more of said sections, wherein:

the elongate main supporting section in use extends along its length at an upwards sloping angle from said first end towards said second end and includes a lower region proximate said first end for supporting said person's upper torso and an upper region proximate said second end for supporting said person's head;

said at least two legs include at least one rear leg proximate said lower region and at least one front leg proximate said upper region, the rear leg(s) being adapted for engaging with a seat on which said person is seated and the front leg(s) being adapted for engaging with a floor beneath said seat and being of longer length than said rear leg to provide said upward sloping angle, wherein said seat is elevated with respect to said floor, said at least two legs being movable relative to said sections to enable the section(s) to fold flat with said legs when not in use; and the supporting surface in the upper portion of the main supporting section extends without obstruction fully towards the second end of the main supporting section so that a seated resting person's head may be supported by said unobstructed supporting surface in the upper region across the full extent of the upper portion towards said second end.

2. A resting support as claimed in claim 1, including a pair of side supporting sections for supporting directly said person's arms, the side supporting sections each being connected to the main supporting section by a hinge connection and in use being positioned so as to support said person's arms at a lower level than said person's head, in which the side supporting sections are each, by means of the hinge connection, movable relative to the main supporting section and said at least two legs to enable the side supporting sections and the main supporting section to fold flat with said legs when not in use.

3. A resting support as claimed in claim 2, in which the main supporting section has left and right sides relative to said person, the side supporting sections being positioned at said left and right sides of the main supporting section.

4. A resting support as claimed in claim 3, in which the main supporting section has a supporting surface for supporting directly said seated resting person's upper torso and head and each side supporting section has a supporting surface for supporting directly said person's arms, and said hinge connections permit each of the side supporting sections to move relative to the main supporting section so that the supporting surfaces of the side supporting sections each conform with the supporting surface of the main supporting section at said left and right sides of the main supporting section when the side supporting sections are not in use to support said person's arms.

5. A resting support as claimed in claim 2, in which the side supporting sections are each connected to the main supporting section at said lower region of the main supporting section by means of said hinge connection.

6. A resting support as claimed in claim 5, in which the side supporting sections are movably connected to said lower region by means of at least one hinge.

7. A resting support as claimed in claim 5, in which the side supporting sections are movably connected to said lower region by means of a flexible linkage.

8. A resting support as claimed in claim 2, in which a member extends from at least one of said legs for locating the position of said side supporting sections when used to support said person's arms at said lower level, said member being movable relative to said at least one leg to enable the side supporting section(s) to fold flat with said at least one leg when not in use.

9. A resting support as claimed in claim 8, in which there is one front leg proximate said upper region and a pair of rear legs proximate said lower region, said rear legs being spaced apart to be positioned in use either side of said person's legs or hips.

10. A resting support as claimed in claim 9, in which said member is elongate and is rotatably connected to said front leg about a mid-point of said elongate member.

11. A resting support as claimed in claim 1, in which there is one front leg proximate said upper region and a pair of rear legs proximate said lower region, said rear legs being spaced apart to be positioned in use either side of said person's legs or hips.

12. A resting support as claimed in claim 1, in which said at least two legs are provided as separate independent supports that substantially span the extent of the main supporting section so that the weight of said person resting on said sections lies substantially between the span of said separate independent supports.

13. A resting support as claimed in claim 1, in which the main supporting section is provided by a continuous surface.

14. A resting support as claimed in claim 13, in which the continuous surface is planar.

15. A resting support as claimed in claim 13, in which the continuous surface is concave.

16. A resting support as claimed in claim 1, in which said legs provide separate and independent support at opposite edges of the main supporting section.

17. A resting support as claimed in claim 1, in which the first end of the main supporting section has a central portion that terminates at a lowermost edge of said first end and the second end of the main supporting section has a central portion that terminates at an uppermost edge of said second end.

18. An item of luggage comprising: an external casing; means for opening and closing said external casing, an external surface of said casing defining a plurality of external sides of said item of luggage, at least one of said sides including a substantially rigid external panel; and means by which said panel may be removed and attached to said side of the casing; wherein the panel is formed from a collapsed resting support that is detachably secured to said side of the casing, said resting support for supporting portions of a resting person in a forwards leaning seated position, comprising at least one supporting section including a main supporting section for supporting directly said seated resting person's upper torso and head, and means for positioning and supporting said section(s) above the lap of said person including at least two legs that extend downwardly from one or more of said sections, wherein:

the main supporting section in use extends at an upwards sloping angle from a lower region for supporting said person's upper torso towards an upper region for supporting said person's head;

said at least two legs include at least one rear leg proximate said lower region and at least one front leg proximate said upper region, the rear leg(s) being adapted for engaging with a seat on which said person is seated and the front leg(s) being adapted for engaging with a floor beneath said seat, wherein said seat is elevated with respect to said floor, said at least two legs being movable relative to said sections to enable the section(s) to fold flat with said legs when not in use.

19. A method of using a resting support to rest a person's body, the resting support comprising at least one supporting section including a main supporting section, the main supporting section having a supporting surface for supporting directly said seated resting person's upper torso and head, the main supporting section being elongate between opposite first and second ends of the main supporting section such that the supporting surface may provide support along its length to said seated resting person's upper torso and head, and means for positioning and supporting said section(s) above the lap of said person including at least two legs that extend downwardly from one or more of said sections, wherein:

the elongate main supporting section in use extends along its length at an upwards sloping angle from said first end towards said second end and includes a lower region proximate said first end for supporting said person's upper torso and an upper region proximate said second end for supporting said person's head;

said at least two legs include at least one rear leg proximate said first end and at least one front leg proximate said second end, the rear leg(s) being adapted for engaging with a seat on which said person is seated and the front leg(s) being adapted for engaging with a floor beneath said seat and being of longer length than said rear leg, wherein said seat is elevated with respect to said floor, said at least two legs being movable relative to said sections to enable the section(s) to fold flat with said legs when not in use; and the supporting surface in the upper portion of the main supporting section extends without obstruction fully towards the second end of the main supporting section;

wherein the method comprises the steps of:

i) unfolding the legs and said section(s) so that the legs extend away from said section(s);

ii) engaging said rear leg(s) on a seat on which said person is seated;

iii) engaging said front leg(s) with a floor beneath said seat so that said elongate main supporting section extends along its length at an upwards sloping angle from said first end towards said second end;

iv) using the means for positioning and supporting said section(s) so that the main supporting section is positioned above the lap of said seated person such that said lowermost edge of said first end is nearest the lap of person; and v) resting the upper torso and head on the main supporting section such that the head and torso rest along the length of the main supporting section with head being supported by said unobstructed supporting surface in the upper region proximate said second end.

20. A method as claimed in claim 19, in which the method comprises the step of folding the legs flat with said section(s) after the person has finished resting using the resting support.

21. A method as claimed in claim 19, in which the legs for positioning and supporting said sections are provided as separate independent supports which substantially span the extent of the main supporting section and in which step v) includes positioning the weight of said person resting on said sections substantially between the span of said separate independent supports.

22. A resting support for supporting portions of a resting person in a forwards leaning seated position, comprising at least one supporting section including a main supporting section for supporting directly said seated resting person's upper torso and head, and means for positioning and supporting said section(s) above the lap of said person including at least two legs that extend downwardly from one or more of said sections, wherein:

the main supporting section in use extends at an upwards sloping angle from a lower region for supporting said person's upper torso towards an upper region for supporting said person's head;

said at least two legs include at least one rear leg proximate said lower region and at least one front leg proximate said upper region, the rear leg(s) being adapted for engaging with a seat on which said person is seated and the front leg(s) being adapted for engaging with a floor beneath said seat, said at least two legs being movable relative to said sections to enable the section(s) to fold flat with said legs when not in use;

the resting support including a pair of side supporting sections for supporting directly said person's arms, the side supporting sections each being connected to the main supporting section by a hinge connection and in use being positioned so as to support said person's arms at a lower level than said person's head, in which the side supporting sections are each, by means of the hinge connection, movable relative to the main supporting section and said at least two legs to enable the side supporting sections and the main supporting section to fold flat with said legs when not in use.

* * * * *